United States Patent [19]

Kitchen

[11] Patent Number: 4,777,841

[45] Date of Patent: Oct. 18, 1988

[54] ROTARY SHAFT ACTUATOR WITH IMPROVED LEVER ATTACHMENT

[75] Inventor: Robert D. Kitchen, Freeport, Ill.

[73] Assignee: Honeywell Inc., Minneapolis, Minn.

[21] Appl. No.: 432,577

[22] Filed: Oct. 4, 1982

[51] Int. Cl.[4] ..... G05G 1/10

[52] U.S. Cl. ..... 74/559; 403/359

[58] Field of Search ..... 74/523, 524, 525, 543, 74/545, 548, 559; 403/359; 411/437

[56] References Cited

U.S. PATENT DOCUMENTS

| | | | |
|---|---|---|---|
| 1,128,524 | 2/1915 | Royce | 74/559 |
| 1,637,520 | 8/1927 | Dodge | 74/559 |
| 1,644,261 | 10/1927 | Marles | 74/559 |
| 3,169,805 | 2/1965 | Dieterich | 74/543 |
| 3,255,641 | 6/1966 | Russell | 74/559 |
| 3,385,129 | 5/1968 | Duncan et al. | 74/545 |

*Primary Examiner*—Gary L. Smith
*Assistant Examiner*—Michael F. Trettel
*Attorney, Agent, or Firm*—Charles L. Rubow

[57] ABSTRACT

A method and structure for securing a lever to a shaft of a rotary actuator in a manner which facilitates small angular adjustments between the lever and shaft is disclosed. The lever is clamped onto a segment of the shaft which is formed with a helical knurl. The lever may be slightly repositioned along the shaft to facilitate angular adjustments smaller than the angle between adjacent ridges of the knurl where the ridges have caused corresponding indentations in the lever.

9 Claims, 1 Drawing Sheet

ROTARY SHAFT ACTUATOR WITH IMPROVED LEVER ATTACHMENT

BACKGROUND OF THE INVENTION

The invention disclosed herein relates generally to rotary shaft and lever actuators, and more specifically to a method and structure for reliably maintaining the radial position of a lever on a shaft while facilitating small angular adjustments in radial positioning. The invention has been found particularly useful in connection with rotary actuators for electrical limit switches.

Certain electrical limit switch designs, among a wide variety of other rotary shaft operated mechanisms, require a shaft having a radially extending lever attached thereto in a fixed radial position. A variety of methods and arrangements have been devised for accomplishing the desired attachment. One common arrangement is to grip or clamp the shaft in an aperture in a split end of the lever. Clamping may be accomplished by means of a bolt or screw extending at least partially through the split end.

It is known to further insure against slippage of the lever on the shaft by providing a knurled surface on the shaft in the form of a series of small ridges aligned with the shaft around the circumference of a segment thereof. As a lever is clamped onto the shaft, the ridges tend to bite into or deform the mating surface on the lever. This results in an attachment which is secure against circumferential slippage.

One disadvantage which has been experienced with the foregoing arrangement is that because the mating surface on the lever becomes deformed once the lever is attached, it is thereafter difficult to adjust the angle of the lever on the shaft between angular positions in which the ridges on the shaft coincide with indentations in the lever. This may be a significant problem where the actuator is part of a limit switch on a machine tool or other apparatus in which fine adjustment is important.

The applicant has discovered a method and structure which avoids this limitation on adjustability while maintaining the security against circumferental slippage afforded by a knurled surface on the shaft.

SUMMARY OF THE INVENTION

The present invention is a method and structure for facilitating angular adjustability of a lever on a knurled shaft through the use of a helically configured knurl. Apparatus in accordance with the invention comprises a rotary actuator shaft having a segment with a helically knurled surface thereon and a lever adapted to grip the knurled surface, at least the portion of the lever which mates with the shaft being formed of a deformable material. The helical knurl may be at an angle of 15° from alignment with the shaft. The method of the present invention comprises forming a helical knurl on a segment of an actuator shaft, providing an aperture with deformable walls in a lever which mates with the shaft, and releasably clamping the lever around the shaft.

In accordance with the applicant's invention, small adjustments in the angular relationship between the shaft and lever are facilitated by axially repositioning the lever along the shaft. For purposes of describing this invention, a small adjustment is defined as an angular adjustment less than the angle between adjacent ridges of the knurled surface.

DESCRIPTION OF THE PREFERRED EMBODIMENT

Figure 1:
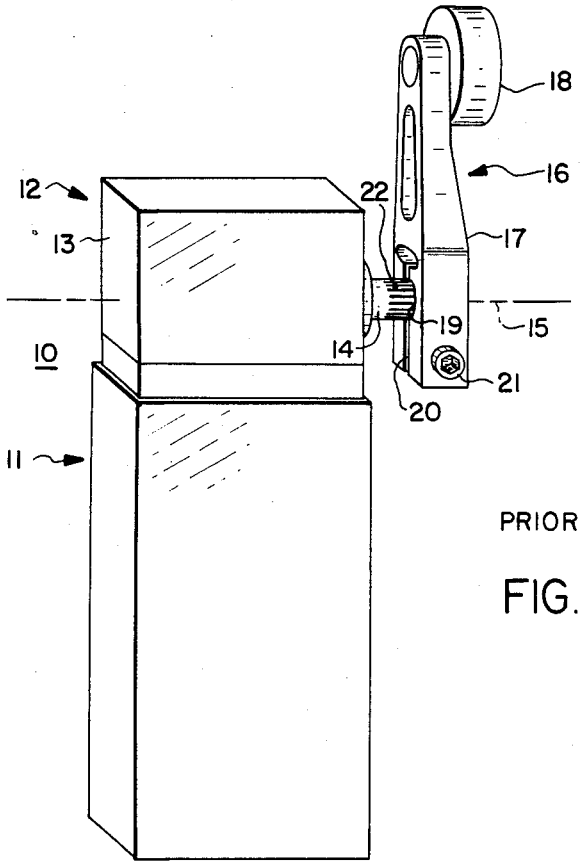
PRIOR ART FIG. 1
FIG. 1 is a perspective view of an electrical limit switch having a prior art rotary actuator whose shaft is formed with a straight knurl.

In FIG. 1, reference numeral 10 generally identifies a prior art electrical limit switch assembly comprising an electrical switch 11 and a switch actuator 12 designed to operate switch 11 in response to predetermined mechanical motion. Actuator 12 includes a housing 13 mounted on switch 11 and serving to support a shaft 14 for rotary motion about a central longitudinal axis 15 along which the shaft extends. Switch 11 and actuator 12 are designed to cooperate so that the switch is actuated by rotary motion of shaft 14.

Shaft 14 is rotated by means of a lever assembly 16 which includes a lever 17 clamped onto an end of shaft 14 and extending radially from axis 15. As shown, lever assembly 16 also includes a tracking roller 18 at the opposite end of lever 17 from shaft 14. Lever 17 is configured with an aperture 19 adapted to receive the end of shaft 14. Lever 17 is formed with a split end in which the split 20 extends to aperture 19 so as to permit the lever to be clamped onto the end of shaft 14. The split end of lever 17 is clamped onto shaft 14 by means of a bolt or screw 21.

Shaft 14 is formed with a segment having a knurled surface 22, a portion of which extends into lever 17 to aid in preventing slippage of the lever on the shaft. Shaft 14 is typically formed of steel and lever 17 is typically formed of a material such as diecast aluminum which is more ductile than the shaft material. Thus, as screw 21 is tightened to clamp lever 17 onto shaft 14, the ridges of the knurled surface 22 form indentations in the wall of aperture 19, enhancing the slippage free attachment of the lever to the shaft.

Figure 3:
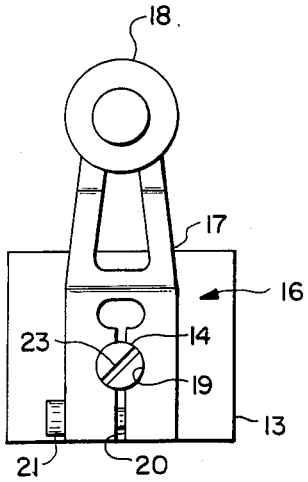
FIG. 3 is a side view of the actuator of FIG. 2, showing additional details of the actuator lever.

Lever assembly 16 may be repositioned to extend along a different radius from shaft 14 by loosening screw 21 and rotating the lever assembly with respect to the shaft. As illustrated in FIG. 3, a slot 23 may be provided in the end of shaft 14 to hold the shaft while rotating the lever assembly. However, once lever assembly 16 has been tightly clamped on shaft 14, it is generally only possible to resecure the lever assembly to shaft in positions in which the ridges on the shaft coincide with indentations in the lever. Thus, adjustment is feasible only in increments equal to the pitch between ridges on knurled surface. Attempts to angularly reposition lever assembly 16 intermediate such incremental positions are generally not successful because the lever assembly tends to rotate until the ridges and indentations coincide.

Figure 2:
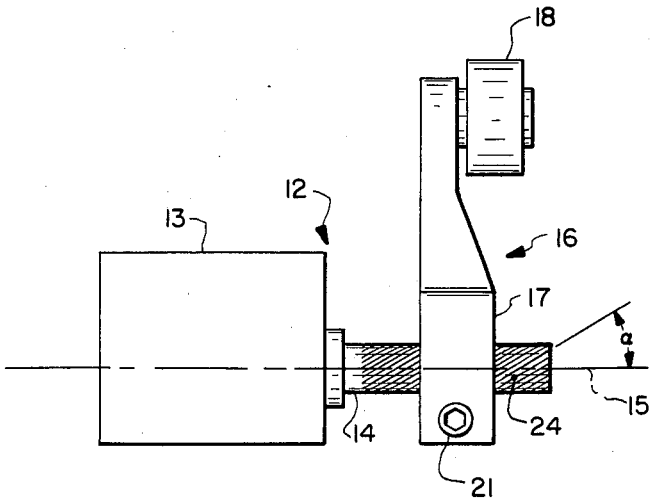
FIG. 2 is a frontal view of a rotary actuator similar to the rotary actuator shown in FIG. 1, but having a helically knurled, shaft in accordance with the applicant's invention.

The applicant has found that this characteristic can be avoided and fine angular adjustment of lever assembly 16 on shaft 14 facilitated by providing a helical knurl, identified by reference numeral 24 in FIG. 2, on the segment of shaft 14 which mates with lever assembly 16. A helix angle $\alpha$ of 15° has been found to perform quite satisfactorily. The ridges are sufficiently close to being aligned with axis 15 that there is no significant tendency for lever assembly 16 to slip circumferentially on shaft 14. Yet, the helix angle of the ridges is sufficient to provide for continuous angular adjustment of the lever assembly about the shaft. Such angular adjustment is accompanied by slight axial repositioning of lever assembly 16 along shaft 14. However, in most applications, such axial repositioning can be accommodated with no disadvantage.

In accordance with the foregoing description, the applicant has provided a unique, simple method and structure for securing a lever on a shaft so as to avoid angular slippage, while facilitating small angular adjustments between the lever and the shaft. Although a specific embodiment of the applicant's invention has been shown and described for illustrative purposes, other variations and implementations in accordance with the applicant's teachings will be apparent to those skilled in the relevant arts. The applicant does not intend that coverage should be limited to the illustrated embodiment, but only the the terms of the following claims.

The embodiments of the invention in which an exclusive property or right is claimed are defined as follows:

1. In actuator apparatus of the type having a rotatably supported shaft and a lever adapted to be attached to a knurled segment of the shaft in a fixed radial position for rotating the shaft in response to an external input, improved structure for facilitating small adjustments in the radial position of the lever, comprising:

a shaft extending along a central longitudinal axis, and having a segment whose surface is helically knurled;

support means for supporting said shaft for rotation about the central longitudinal axis; and a lever having an aperture therein adapted to receive at least a portion of the helically knurled segment of said shaft, the aperture being located so that at least a portion of the lever extends radially from the axis of said shaft, said lever including deformable means adapted to grip the helically knurled segment and at least partially conform thereto so as to maintain said lever in a fixed radial relationship relative to said shaft, whereby small adjustments to the radial positioning of said lever are facilitated by axially repositioning said lever along said shaft.

2. The actuator apparatus of claim 1 wherein the helical knurl is at an angle of 15° relative to the central longitudinal axis of said shaft.

3. The actuator apparatus of claim 2 wherein the deformable means on said lever for gripping said shaft comprises:

a split in said lever extending to the aperture therein; and means for clamping the portions of said lever on opposite sides of said split around said shaft.

4. The actuator apparatus of claim 1, 2 or 3 further including:

an electrical switch; and means for mounting said support means on said electrical switch, the actuator being adapted to operate the electrical switch in response to rotation of said shaft.

5. The actuator apparatus of claim 4 wherein: said shaft is fabricated of steel; and said lever is fabricated of aluminum.

6. Rotary actuator apparatus with improved adjustment characteristics, comprising:

a shaft extending along and rotatable about a central longitudinal axis, and having a knurled segment with a helically knurled surface thereon;

a lever with attachment means adapted to grip the knurled segment of said shaft so that at least a portion of said lever extends radially therefrom, said lever being formed of a deformable material, the portion of which grips the knurled segment at least partially conforming to the knurled segment so as to secure the angular relationship between said shaft and said lever, small adjustments in the angular relationship being accomplished by axially repositioning said lever along said shaft.

7. The rotary actuator apparatus of claim 6 wherein the helix angle of the helical knurl is 15°.

8. The rotary actuator apparatus of claim 7 wherein the attachment means of said lever comprises:

an aperture in said lever adapted to receive the knurled segment of said shaft, the aperture being in a split end of said lever so as to permit said lever to be closed on said shaft; and releasable means for urging said lever closed on said shaft.

9. The rotary actuator apparatus of claim 6, 7 or 8 further including:

an electrical switch; and means for coupling rotation of said shaft to said switch so that said switch is actuatable by said shaft.

* * * * *